US007967413B2

(12) United States Patent
Koizumi et al.

(10) Patent No.: US 7,967,413 B2
(45) Date of Patent: Jun. 28, 2011

(54) LIQUID EJECTION HEAD AND LIQUID EJECTION METHOD

(75) Inventors: Ryoichi Koizumi, Yokohama (JP); Shuichi Murakami, Kawasaki (JP); Yasunori Takei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 475 days.

(21) Appl. No.: 12/126,715

(22) Filed: May 23, 2008

(65) Prior Publication Data

US 2008/0291244 A1 Nov. 27, 2008

(30) Foreign Application Priority Data

May 25, 2007 (JP) ..... 2007-139176
Apr. 17, 2008 (JP) ..... 2008-108233

(51) Int. Cl.
*B41J 2/14* (2006.01)

(52) U.S. Cl. ..... 347/47
(58) Field of Classification Search ..... 347/47
See application file for complete search history.

(56) References Cited

U.S. PATENT DOCUMENTS 6,254,219 B1 * 7/2001 Agarwal et al. ..... 347/47

FOREIGN PATENT DOCUMENTS

JP 06-286138 10/1994

* cited by examiner

*Primary Examiner* — Jerry T Rahll
(74) *Attorney, Agent, or Firm* — Canon USA Inc IP Division

(57) ABSTRACT

A liquid ejection method is provided which ejects small-volume droplets from ejection openings and causes them to reliably combine together on the fly into a large droplet that is less susceptible to influences of air flows, thus realizing a printing with reduced droplet landing position deviations. To that end, each of the ejection openings is constructed of two openings spaced apart and a slit-like constricted connection portion that connects the two openings together.

2 Claims, 6 Drawing Sheets

LIQUID EJECTION HEAD AND LIQUID EJECTION METHOD

BACKGROUND OF THE INVENTION

1. Field of the Invention

The present invention relates to a liquid ejection head and a liquid ejection method of performing printing by ejecting a liquid, and more particularly to a method of joining a plurality of liquid droplets during ejection.

2. Description of the Related Art

A print head, used in ink jet printing and that performs printing by ejecting a liquid onto a print medium, applies energy such as heat to the liquid to cause a status change in the liquid accompanied by a rapid liquid volume change, thereby ejecting the liquid from ejection openings by a status change-produced force.

With this ink jet printing system, high-quality images can be printed at high speed with low noise. Further, the ink jet printing system is able to arrange liquid ejection openings at high density in the print head. The ability of the ink jet printing apparatus to arrange the ejection openings at high density provides many advantages. Among others, the printing apparatus itself can be reduced in size and color images obtained easily. Because of these advantages, the ink jet printing method in recent years has found an increasingly wide range of use with office equipment, such as printers, copying machines, and facsimiles, and also in industrial systems such as cloth pattern printing apparatuses.

In such an ink jet printing system, a liquid to be ejected gets elongated before being disconnected from the body of liquid to form a droplet that lands on a print medium. At this time, the liquid droplet intended to reach the print medium has a front end part of the droplet (main droplet) and a column part (ink tail). Generally, the ink tail is smaller in volume and slower than the main droplet and thus lands on the print medium at a position deviated from that of the main droplet, degrading the print quality. It is therefore necessary to disconnect the ink as early as possible. To meet this requirement, it is desired that the ink droplet ejected from the ejection opening be as small in total volume as possible. This is because a reduced volume of liquid droplet naturally results in an early disconnection. That is, one droplet is divided into a plurality of smaller droplets to reduce the volume per droplet as they are ejected.

One example method based on this idea involves ejecting a plurality of droplets from a plurality of ejection openings in a manner that joins them together on the fly. By ejecting the liquid in the form of a plurality of small droplets, they can be split from the body of the liquid early. Combining the small droplets into a larger droplet on the fly can reduce the influence of air flow, preventing a possible degradation of print quality.

Japanese Patent Laid-Open No. 06-286138 describes an example method of ejecting small liquid droplets and then joining them into a larger droplet. With this method, two ejection openings are provided for one ink flow path, and two small ink droplets ejected from the two ejection openings are combined to form a larger droplet on the fly.

The smaller volume of droplet, however, has a disadvantage in that it is more easily affected by air resistance and therefore air flows around the print head. This will result in positional deviations of printed dots on the print medium, degrading the print quality. It is therefore desired that an ejected ink droplet be small in volume as it leaves the nozzle but, after it has parted from the nozzle, become larger on the fly. Therefore, the construction of Japanese Patent Laid-Open No. 06-286138 has no problem when two droplets fly under an ideal condition. But in practice, an ejection state of individual ink droplets sometimes varies according to actual conditions of use. The ejection state variations (deflections of ejection direction and variations in ejection volume) may result in a combined ink droplet being deflected from an intended direction and, in a worst case, small ink droplets failing to join together.

A distance between two holes or ejection openings, that causes two independent ink droplets to have a columnar shape as they leave the ejection openings and then to combine together on the fly to finally land on a print medium as a single droplet, is very subtle. So, it is difficult, with the present construction as is, to eject ink droplets in a way that can stably keep their ejected state. Even if the ejection of independent droplets and the subsequent joining of droplets should be able to be realized under a certain condition, since the two-hole distance is based on the subtle condition, any change in conditions during use, such as an ink property and a surface state of ejection openings, can result in the independent droplets failing to combine or the ink being ejected as a single dot from the beginning, thus degrading the print quality.

SUMMARY OF THE INVENTION

It is therefore an object of this invention to provide a liquid ejection method that causes small-volume ink droplets to be ejected from ejection openings and to combine together on the fly to become a larger droplet which is not easily affected by air flows, thus realizing a printing operation with little dot landing position deviations.

In a first aspect of the present invention, there is provided a liquid ejection head for ejecting a liquid from an ejection opening, wherein: the ejection opening includes two first areas and a second area, each of the two first areas having semicircular shape, the second area having a rectangular connection portion for connecting straight parts of the two semicircular-shaped first areas, a radius of each of the first area is more than twice the length of the second area in a direction crossing the connecting direction, and the ejection opening is communicated with a bubble generation chamber.

In a second aspect of the present invention, there is provided a liquid ejection method for ejecting a liquid from ejection openings, comprising: a step of preparing a plurality of first areas forming openings of each of the ejection openings and a second area constructed of a connection portion which is narrower than the first areas and which connects the plurality of the first areas together; a first ejection step of forming a plurality of liquid columns corresponding to the plurality of the first areas while at the same time connecting the liquids ejected from the plurality of the first areas by a liquid ejected from the second area; a second ejection step of causing the liquid to fly with the liquid columns separated from each other, the liquid columns each comprising one main droplet portion and the same number of tail portions as the plurality of the first areas; and a third ejection step of causing the tail portions to unite with the main droplet portion to form a liquid droplet.

With this invention, a liquid droplet to be ejected is divided into a plurality of liquid columns as it passes through the ejection opening, thus making individual column portions of the droplet narrower to advance the timing when the droplet is disconnected from the body of liquid. Between the individual liquid columns is provided a contact portion that causes the liquid column portions to get united quickly after the droplet has parted from the body of the liquid. Thus the liquid, while flying, can be made a large droplet. This makes it possible to provide a liquid ejection method capable of realizing highly precise printing which is hardly susceptible to influences of mist and satellites and influences of air flows and therefore has minimal landing position deviations.

Further features of the present invention will become apparent from the following description of exemplary embodiments (with reference to the attached drawings).

DESCRIPTION OF THE EMBODIMENTS

Figure 1:
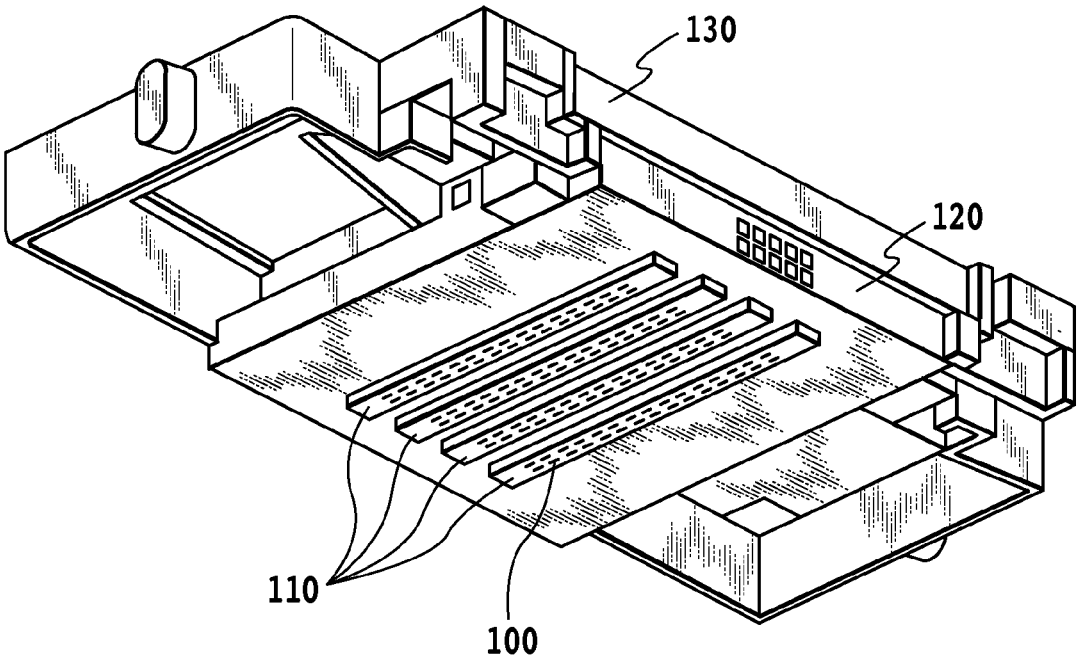
FIG. 1 is a perspective view showing a print head that can apply the present invention.

The present invention provides that for a liquid droplet, which is formed as a plurality of liquid columns when it passes through the ejection opening and that after the droplets have left the ejection opening, the column parts of the droplets are made to combine together into a larger droplet.

As for the time it takes for a droplet to be separated from the body of the liquid after a bubble has been formed (hereinafter referred to simply as a droplet disconnection time), the shorter the time, the smaller the volume of mist and satellites generated. This is because, as the droplet disconnection time increases, a trailing part of the droplet (or ink tail), which is a column part connecting to the main droplet, gets elongated, and those portions in the trailing part that fail to connect to the main droplet become mist and satellite.

To shorten the liquid column, it is effective to reduce a diameter of an ejection opening if an ejection speed is the same. However, an actual ejection opening diameter is closely related to an ejection volume and thus cannot be changed vigorously. Under this situation, the inventors have tried to cope with both the reduction of ejection opening diameter and the shortening of the droplet disconnection time by dividing the ejection opening and combining together the droplets ejected from individual ejection openings.

This attempt, however, reduces the size of the droplets ejected from individual ejection openings, with the result that the droplets are more susceptible to external influences (as from air flows produced by a moving head), causing degradations in droplet landing precision. The external influences induce deviations in a timing at which droplets ejected from individual ejection openings merge together, giving rise to a possibility of deflections of ejection direction and, in a worst case, of individual droplets failing to unite.

To deal with these contradicting problems, the inventors have found a liquid ejection method that prevents droplets from being easily susceptible to external influences by employing a technique of partly separating liquid droplets in order to shorten the droplet disconnection time and maintain the same droplet size as they conventionally have been. How the droplets are partly separated will be explained in detail by referring to the drawings.

(Mechanism During Ejection)

Figure 3:
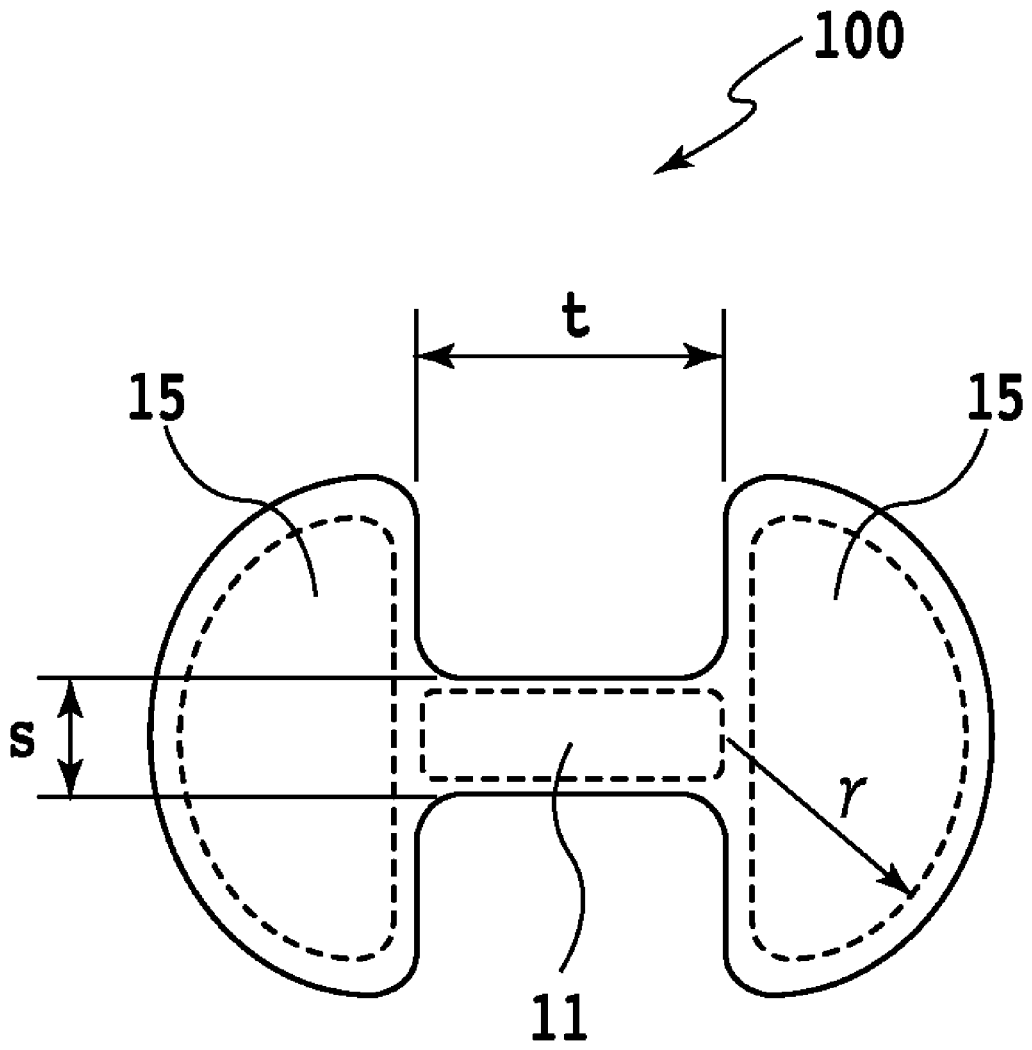
FIG. 3 illustrates details of an ejection opening of the first embodiment.
Figure 4:
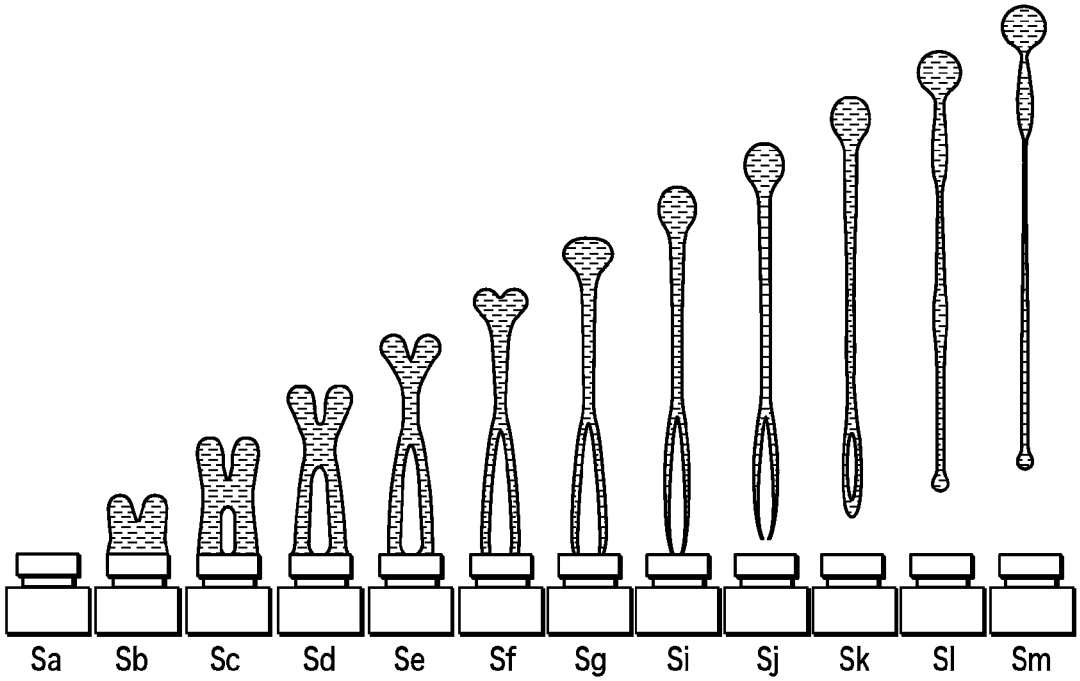
FIG. 4 illustrates in successive stages how a liquid is ejected from an ejection opening of the first embodiment, as obtained by a simulation.

FIG. 4 shows how a droplet is ejected according to this invention. Referring to FIG. 4 an ejection mechanism will be explained. An ejection opening 100, as shown in FIG. 3, has a plurality of opening portions 15 connected by a slit, which forms a constricted connection portion 11. In a stage Sa before ejection, ink is filled in areas of opening portions and the constricted connection portion 11.

When a bubble begins to be formed, ink is ejected first from the individual opening portions 15, avoiding the constricted connection portion 11 which has a narrow opening width and a large flow resistance during ejection. That is, two independent droplets of ink that correspond to the main droplet are forced out. In a stage Sb, ink also comes out of the constricted connection portion 11 that has a high flow resistance. The ink that comes out with a delay from the slit 11 is shaped like a wall connecting the independently ejected ink from the opening portions 15.

In stages Sc and Sd, ink flows out only from the two opening portions 15 with low flow resistance, forming two columnar ink tail portions. Thus, what is formed in stage Sd is two main droplets, two ink tail portions and a wall that was present in the constricted connection portion 11 before ejection and which bridges the two droplets at an intermediate portion between the main droplets and the ink tail portions.

Then, as shown in stages Se and Sf, the ink flow further continues only from the two opening portions 15 with low flow resistance. At the same time, an ink surface tension of the wall-shaped bridge portion coming out of the constricted connection portion 11 produces an attractive force that begins to draw two separated main droplets and two separated ink tail portions toward each other. In stage Sg, the main droplets are completely united by the attractive force, forming one main droplet portion and two ink tail portions.

Further, in stage Si the ink flow from only the opening portions 15 and the merging of separated tail portions continue. In stage Sj, the ink tails are disconnected from the nozzle. At this time, since a plurality of ink columns are disconnected individually from the body of ink, the droplet disconnection time is significantly reduced in comparison with the same ejection amount and the same ejection speed.

Further, as shown in stage Sk, the merging of the ink tail portions while flying continues until stage S1 where the two ink columns are completely united into a single droplet, ranging from the main droplet portion to the tail portion.

If the constricted connection portion 11 is not provided and ink ejection is performed independently from a plurality of separate openings, droplets ejected from the individual openings lose the attractive force and thus continue to fly independently as is, individually landing on a print medium. Ink droplets ejected independently are difficult to unite stably on the fly. However, in a construction having the constricted connection portion 11 between the opening portions 15 as in this embodiment, liquids ejected mainly from the two opening portions 15 are united at one part by the ink that was present in the constricted connection portion 11 before ejection, with the two ink tail portions separated. Since the ink tail portion of a droplet that is supposed to be ejected as one droplet is ejected in two separate columns, the volume of each of the ink tails ejected from the paired opening portions 15 is half that of the whole ink tail according to a simple calculation, which means that the ink tail becomes narrow.

With the two ink columns connected together at one part by the liquid ejected from the constricted connection portion 11, a surface tension of the liquid of the connecting portion acts as an attractive force, drawing the two droplets toward each other, causing not only head portions of the ink droplets but ink tail portions as well to begin merging together. After merging, they are completely united as one droplet and thus are less susceptible to the influences of air flows than when the ink droplets continue flying separated. Example embodiments capable of realizing the above mechanism will be detailed as follows.

First Embodiment

Now, a first embodiment of this invention will be explained by referring to the accompanying drawings. FIG. 1 is a perspective view showing a print head capable of applying the present invention. The print head of this embodiment includes a support substrate 120, a liquid ejection substrate 110 mounted on the support substrate 120, and a liquid supply member 130. The liquid ejection substrate 110 is formed with a plurality of ejection openings 100 for ejecting liquid. A liquid supplied from the liquid supply member 130 passes through a liquid supply port (not shown) provided in the support substrate 120 to reach the liquid ejection substrate 110. The liquid supplied to the liquid ejection substrate 110 can be ejected from the ejection openings 100 by ejection energy generation devices (electrothermal transducing elements or heaters, not shown) installed in the liquid ejection substrate 110.

Figure 2A:
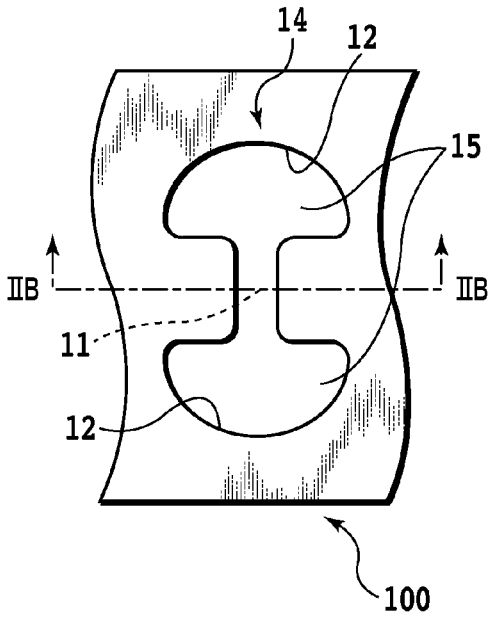
FIG. 2A illustrates ejection openings of a print head as a first embodiment of this invention, as seen from the front.
Figure 2B:
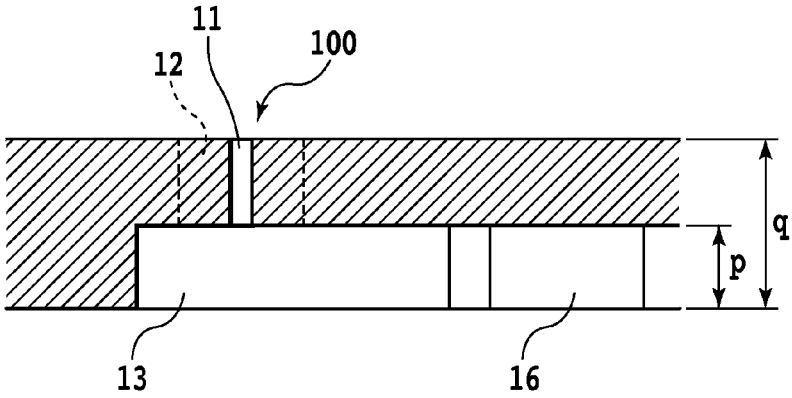
FIG. 2B is a cross-sectional view of the print head taken along the line IIB-IIB of FIG. 2A.
Figure 2C:
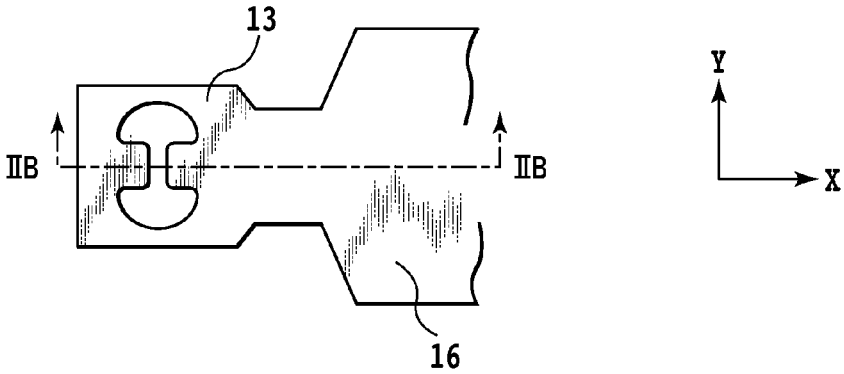
FIG. 2C is a schematic view showing a relation between an ejection chamber and a bubble generation chamber in the print head of the first embodiment.

FIG. 2 illustrates one of the ejection openings 100, which is an essential portion of the print head of this embodiment. FIG. 2A represents a front view of an ejection chamber 14. FIG. 2B represents a cross-sectional view taken along the line IIB-IIB of FIG. 2A. FIG. 2C is a schematic view showing a relation between the ejection chamber 14 and a bubble generation chamber 13 in the print head of the first embodiment. The ejection opening 100 is formed by connecting the two openings 15 having a wall surface 12 by the slit-like constricted connection portion 11. The ejection opening 100 communicates with the bubble generation chamber 13 having the ejection energy generation device therein. A flow path 16 is provided upstream of the bubble generation chamber 13, with respect to ink supply.

FIG. 3 shows details of the ejection opening 100. The ejection opening 100 is characterized in shape by three constitutional portions as shown by broken lines. The three portions of the ejection opening 100 are the pair of roughly semicircular openings 15, or first areas, situated at both ends of the ejection opening 100 with their chord portions opposing each other and the constricted connection portion 11, or an elongate second area, arranged to connect the chord portions. This embodiment is characterized in that the paired openings 15 are arranged at an appropriate distance apart and connected by the constricted connection portion 11 of an appropriate width. With this arrangement, the volume of liquid ejected from the openings 15 and the volume of liquid ejected from the constricted connection portion 11 are controlled. As for the liquid ejected from the ejection opening 100, the openings 15 at both ends eject a relatively large amount of liquid while the constricted connection portion 11 ejects a relatively small amount. This causes the ejection to be executed as if the droplets ejected from the two independent ejection openings combine together.

In the liquid droplet ejection operation, the ink tail of the droplet is made as narrow as possible. For that purpose, it is effective to reduce an overall volume of a droplet and to divide it into multiple smaller dots for ejection. Further, while flying, the smaller dots are combined together to form a larger droplet to make it less susceptible to influences of air flows. As for dimensions of various parts of the ejection opening shown in FIG. 3, this embodiment has r=6.2 μm, s=2.6 μm, and t=7.0 μm. If we let the height of the flow path 16 be p and the total of the heights of the flow path 16 and of the ejection opening wall surface 12 be q (see FIG. 2), the height p=16 μm, dimension q=26 μm, and the ejection volume=5 pl. The liquid used has a viscosity of 2.9 cp and a surface tension of 34 dyn/cm.

A simulation performed on the head of this embodiment with the above dimensions resulted in ejection states as shown in FIG. 4. Further, actual ejection states of the head were checked as described in evaluation 1 and 2.

(Evaluation 1)

Evaluation was conducted as follows. First, in order to check the state and the droplet disconnection time as the liquid column parts from the body of liquid, the ejection opening and its surrounding areas were observed using a camera with strobe light. To verify the effect of this embodiment, a comparison example 1 of round ejection openings with an area (S=60 $\mu m^2$) corresponding to that of a semicircle and a comparison example 2 of round ejection openings with an area (S=120 $\mu m^2$) equivalent to this embodiment were prepared. The ink tail disconnection times were similarly observed to check a relation between them and the ink tail disconnection time of this embodiment. Other constructions of the comparison examples 1 and 2 are adjusted so that their ejection speeds are equal to that of this embodiment. In the construction of this embodiment, two liquid columns were observed to be separate from each other. The droplet disconnection time was found to be almost equal to that of comparison example 1 and much shorter than that of comparison example 2. For equal volume ejections, the droplet disconnection time is generally considered to be related to the volume of satellites and mist. In this invention, when the liquid columns are disconnected, it is considered that the condition equivalent to that of the semicircular liquid column of this embodiment is established. Therefore, it has been verified from the above that the head of this embodiment produces a smaller volume of satellites and mist than does the conventional head of the same ejection volume.

(Evaluation 2)

Next, an ejection stability of this invention was examined by checking landing dot shapes of droplets ejected from the head of this embodiment and printed images. As to the landing dot shape, if ink columns combine together on the fly and become a single droplet, the dot formed is almost circular. If on the other hand the ink columns fail to unite, the dot formed is shaped like a gourd (see drawings) because of variations in liquid penetration into paper caused by deviations of dot landing timing. Almost all the droplets ejected from the head of this embodiment formed nearly circular dots (see drawings). This indicates that droplets reliably merge together in this embodiment. Another examination was made to check landing dot shapes by using a comparison example 3 whose construction is similar to embodiment 1 except that the slit-like constricted connection portion (ejection opening made up of two semicircular openings) is not provided in the ejection opening of this embodiment. Some of the dots were observed to have a gourd shape. Further, the head was scanned at high speed to print a solid image. The image printed with the head of the comparison example was observed to have something like local color variations. On the contrary, the image printed with the head of this embodiment was found to have apparently less color variations than the image printed with the head of the comparison example. This is considered to have been caused by many factors including: variations in ejection state among individual ejection openings of the head of the comparison example, influences of air flows, a failure of ink droplets to combine together, and degradations in landing precision.

The inventors have examined dimensions of various parts for effective ejection and found that there should be the following relation among various dimensions. That is, let the width of the constricted connection portion 11 be s and the distance between openings be t. Then, in the case of the ejection volume of 2.5-3.5 pl, the distance between the openings 15 is t=3-5 μm for s=0.5-2 μm. For s=2-3.5 μm, the distance between the openings 15 is t=6-10 μm. For s=3.5-5 μm, the distance between the openings 15 is t=20-30 μm.

Let us consider a case where a desired ejection volume to be achieved is 3 pl, for example. For the width of s=1 μm, it is found that the distance is t=4 μm; for the width of s=3 μm, the distance is t=6-10 μm; and for the width of s=4 μm, the distance is t=20-30 μm. Further, if we let the radius of the openings 15 be r, it is found that the radius r should be more than two times the distance s.

Further, although this embodiment uses a semicircle of FIG. 2 for the shape of the openings 15 in the ejection opening 100, other shapes, such as a circle, may also be used. In that case, the dimensional relation of the openings needs only to satisfy the requirement that a long radius of the openings be more than two times the distance s.

As described above, the ejection opening is constructed of two openings spaced apart and a slit-like constricted connection portion that connects the two openings. This construction makes it easy for the liquid ejected from the two openings to be united together by the liquid ejected from the constricted connection portion. As a result, ink droplets can be ejected as small-volume dots and reliably unite on the fly to make the droplets less susceptible to influences of air flows and reduce print deviations, thus realizing a highly precise printing that can take advantage of the merits of both small droplet ejection and large droplet ejection.

Second Embodiment

This embodiment is shown to have three openings, as opposed to two employed in the first embodiment. A second embodiment of this invention will be explained by referring to the accompanying drawings.

Figure 5:
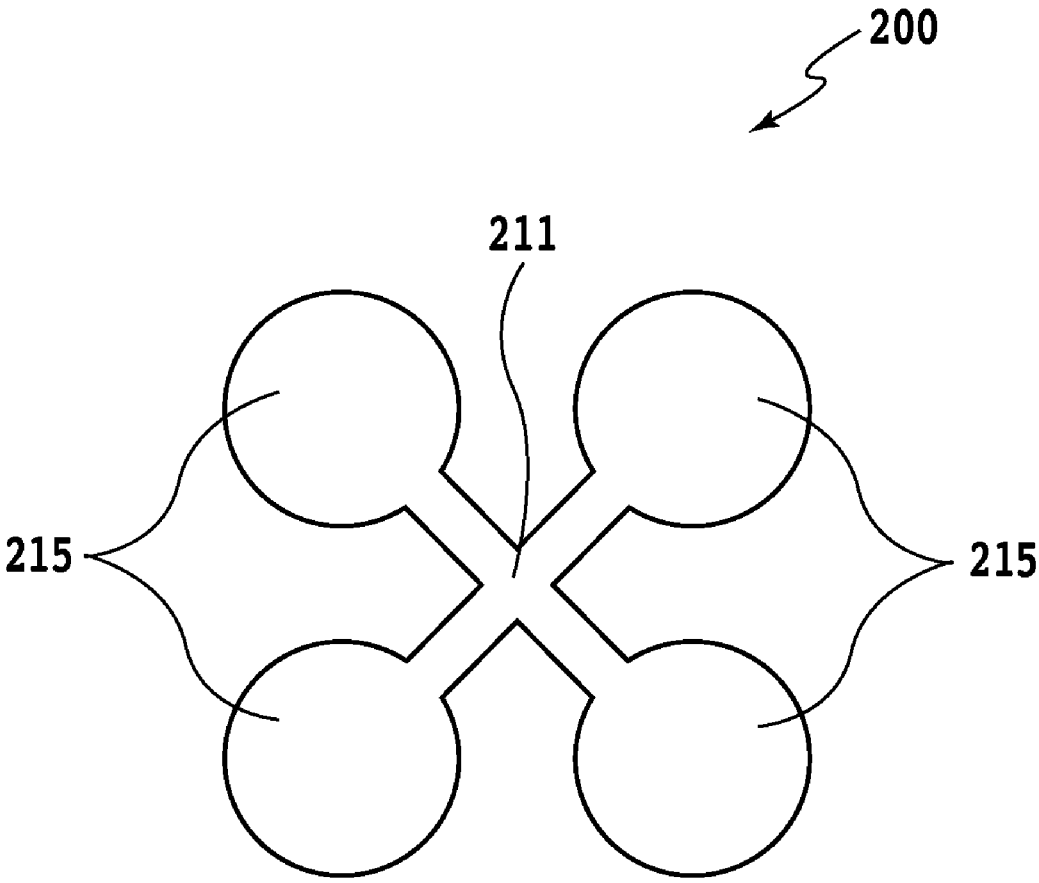
FIG. 5 is a front view of an ejection opening of a second embodiment.

FIG. 5 is a front view showing an ejection opening 200 of this embodiment. The ejection opening 200 of this embodiment has two sets of ejection opening 100 of the first embodiment combined. In the example shown, the openings 15 are circular openings 215, and one set of openings is rotated 90 degrees about a central portion of the constricted connection portion 11 and overlapped on the other set. Other constructions are similar to the first embodiment. This arrangement makes it easy for the droplets to easily combine together.

Third Embodiment

Figure 6:
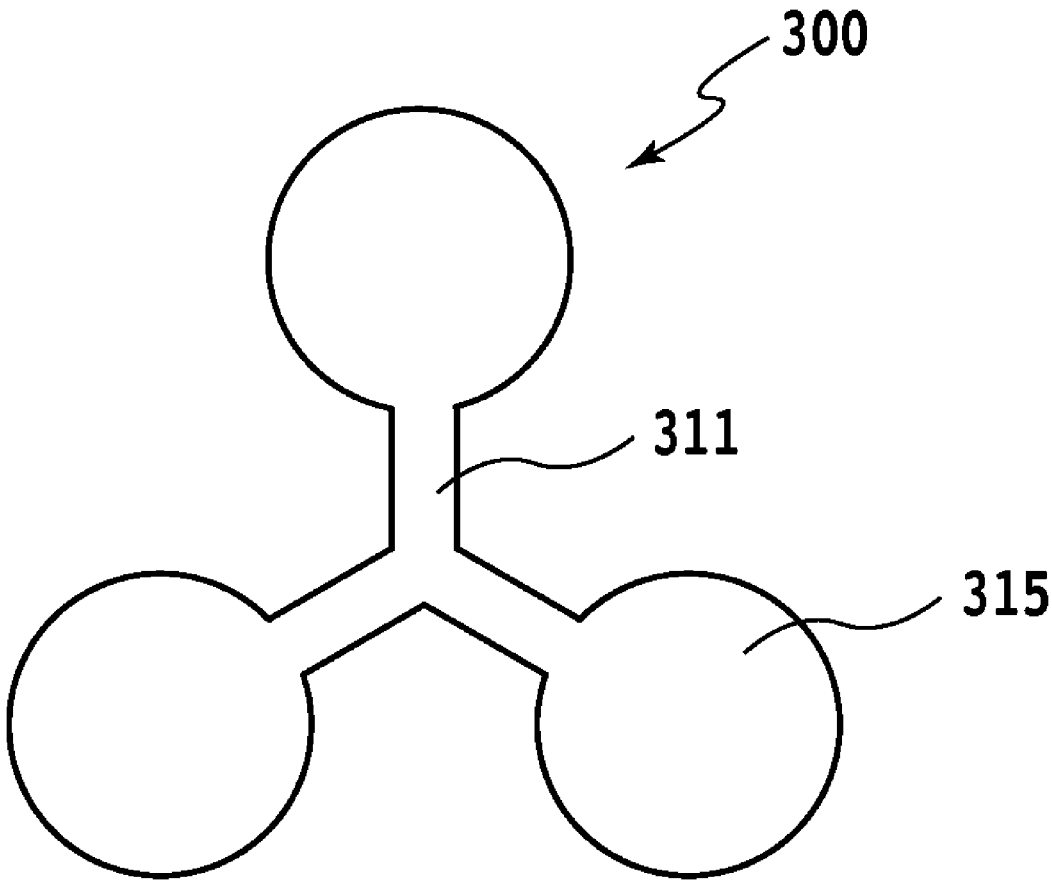
FIG. 6 is a front view of an ejection opening of a third embodiment.

A third embodiment of this invention will be explained by referring to the accompanying drawings. FIG. 6 is a front view showing another ejection opening 300 according to this embodiment. In FIG. 6 the ejection opening is constructed of three openings 315 and a constricted connection portion 311 that connects the openings at the central portion. This construction can also produce the similar effects to those of the first embodiment. As described above, the number and arrangement of the openings can be determined appropriately and these openings need only to be connected together by the constricted connection portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-139176, filed May 25, 2007, and 2008-108233, filed Apr. 17, 2008, all of which are hereby incorporated by reference herein in their entirety.

What is claimed is:

1. A liquid ejection method for ejecting a liquid from ejection openings, comprising:

a step of preparing a plurality of first areas forming openings of each of the ejection openings and a second area constructed of a connection portion which is narrower than the first areas and which connects the plurality of the first areas together;

a first ejection step of forming a plurality of liquid columns corresponding to the plurality of the first areas while at the same time connecting the liquids ejected from the plurality of the first areas by a liquid ejected from the second area;

a second ejection step of causing the liquid to fly with the liquid columns separated from each other, the liquid columns each comprising one main droplet portion and the same number of tail portions as the plurality of the first areas; and a third ejection step of causing the tail portions to unite with the main droplet portion to form a liquid droplet.

2. A liquid ejection method for ejecting a liquid from ejection openings, comprising:

a step of preparing a plurality of first areas forming openings of each of the ejection openings and a second area constructed of a connection portion which is narrower than the first areas and which connects the plurality of the first areas together;

a first ejection step of forming a plurality of liquid columns corresponding to the plurality of the first areas while at the same time connecting the liquids ejected from the plurality of the first areas by a liquid ejected from the second area;

a second ejection step of causing the plurality of liquid columns to grow together and creating one main droplet portion, and creating a plurality of tail portions that follows the main droplet portion connecting to the plurality of first areas; and a third ejection step of causing the tail portions to grow together.

* * * * *